US011548289B2

(12) United States Patent
Hisanaga

(10) Patent No.: US 11,548,289 B2
(45) Date of Patent: Jan. 10, 2023

(54) LIQUID REMAINING AMOUNT DETECTING MECHANISM

(71) Applicant: CANON KABUSHIKI KAISHA, Tokyo (JP)

(72) Inventor: Akane Hisanaga, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 17/210,429

(22) Filed: Mar. 23, 2021

(65) Prior Publication Data

US 2021/0300056 A1 Sep. 30, 2021

(30) Foreign Application Priority Data

Mar. 31, 2020 (JP) ..... JP2020-062944

(51) Int. Cl.
*B41J 2/175* (2006.01)

(52) U.S. Cl.
CPC .. *B41J 2/17566* (2013.01); *B41J 2002/17576* (2013.01)

(58) Field of Classification Search
CPC ..... B41J 2/17566; B41J 2002/17576
See application file for complete search history.

(56) References Cited

U.S. PATENT DOCUMENTS 10,421,285 B2 9/2019 Tanabe et al. ..... B41J 2/17566

FOREIGN PATENT DOCUMENTS

JP 2018-122516 8/2018
WO WO-2018155568 A1 * 8/2018 ..... B41J 11/0095

* cited by examiner

*Primary Examiner* — Justin Seo
(74) *Attorney, Agent, or Firm* — Venable LLP

(57) ABSTRACT

A liquid remaining amount detecting mechanism includes a rotating member that is disposed in a storage chamber of a tank that stores a liquid, and a sensor. The rotating member is rotatable about a shaft and includes a float that receives buoyancy from the liquid, a detection target portion that is detectable by the sensor, and a through-hole into which the shaft is inserted. The sensor is disposed at a position facing a portion of a locus of the detection target portion when the rotating member is rotated. The liquid remaining amount detecting mechanism further includes a liquid pool portion, at least a portion of which is located between an outer peripheral surface of the shaft and an inner peripheral surface of the through-hole to hold the liquid.

20 Claims, 12 Drawing Sheets

LIQUID REMAINING AMOUNT DETECTING MECHANISM

BACKGROUND OF THE INVENTION

Field of the Invention

The present invention relates to a liquid remaining amount detecting mechanism.

Description of the Related Art

In the related art, a liquid ejection device including a tank having a storage chamber for storing a liquid and a liquid ejecting head that ejects a liquid supplied from the storage chamber is known (Japanese Patent Application Laid-Open No. 2018-122516). There is a liquid ejection device that includes a liquid remaining amount detecting mechanism that detects a remaining amount of a liquid stored in a storage chamber. As an example of the remaining amount detecting mechanism, there is one having a configuration in which a rotating member having a specific gravity smaller than a specific gravity of a liquid is rotatably disposed about a shaft in a storage chamber. When a liquid level of the liquid in the storage chamber is equal to or higher than a predetermined height, the rotating member is in a position where the rotating member receives buoyancy from the liquid and rises above the liquid level. When the liquid in the storage chamber decreases and the liquid level is lowered, the rotating member also rotates so as to be lowered due to gravity. The rotation of the rotating member is optically detected by a sensor to detect the remaining amount of a liquid in the storage chamber.

In the liquid ejection device described above, when the remaining amount of the liquid in the storage chamber of the tank decreases, a cartridge provided with a liquid storage chamber is attached, and a liquid in a liquid storage chamber of the cartridge is supplied to the storage chamber of the tank. When the liquid is supplied to the storage chamber of the tank, the liquid level in the storage chamber rises, and the rotating member tries to rotate so as to rise again. However, when the liquid level in the storage chamber is lowered and left in a state where the liquid level is located below a shaft, a small amount of the liquid adhering to an outer peripheral surface of the shaft and an inner peripheral surface of a through-hole into which the shaft is inserted may solidify, and the solidified liquid may fix the outer peripheral surface of the shaft and the inner peripheral surface of the through-hole to each other. As a result, even when the liquid is supplied to the storage chamber, the rotating member cannot rotate smoothly, and it may be difficult to detect the remaining amount of the liquid.

SUMMARY OF THE INVENTION

According to the present invention, there is provided a liquid remaining amount detecting mechanism including: a rotating member that is disposed in a storage chamber of a tank that stores a liquid; and a sensor, in which the rotating member is rotatable about a shaft and includes a float that receives buoyancy from the liquid, a detection target portion that is detectable by the sensor, and a through-hole into which the shaft is inserted, the sensor is disposed at a position facing a portion of a locus of the detection target portion when the rotating member is rotated, and the liquid remaining amount detecting mechanism further includes a liquid pool portion, at least a portion of which is located between an outer peripheral surface of the shaft and an inner peripheral surface of the through-hole to hold the liquid.

Further features of the present invention will become apparent from the following description of exemplary embodiments with reference to the attached drawings.

DESCRIPTION OF THE EMBODIMENTS

Figure 1:
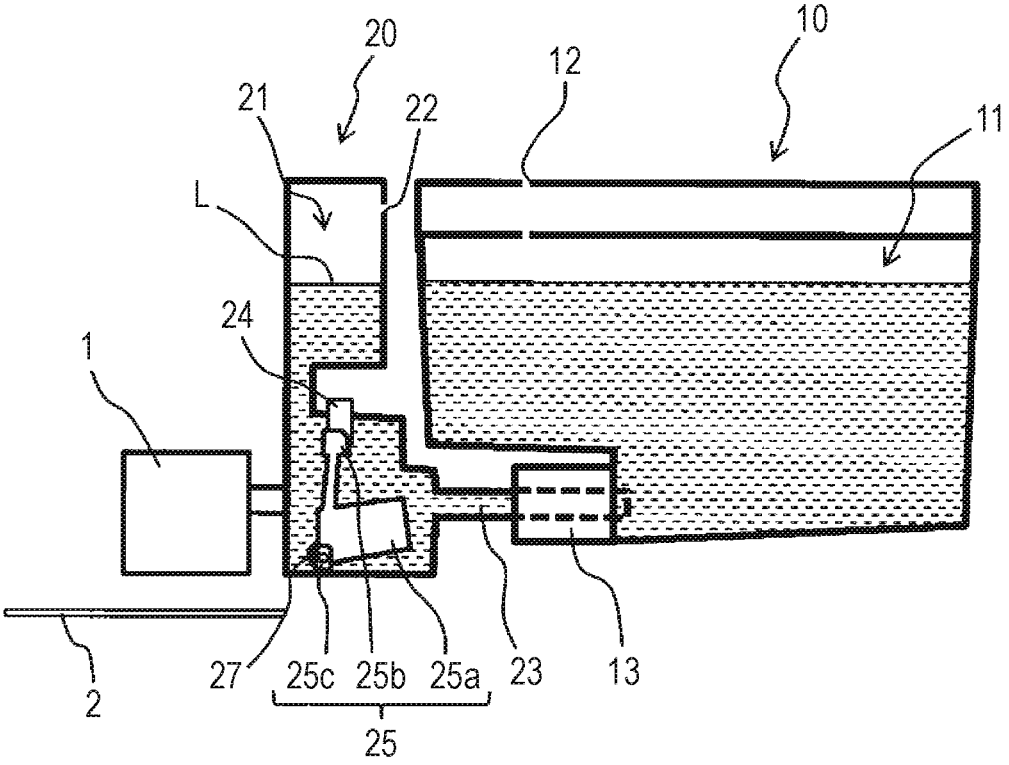
FIG. 1 is a cross-sectional view schematically illustrating a main part of a liquid ejection device according to a first embodiment of the present invention.

The present invention has been made in view of the above-described problems, and an object of the present invention is to provide a liquid remaining amount detecting mechanism and a liquid ejection device capable of suppressing difficulty in detecting a remaining amount of a liquid in a storage chamber due to solidification of a liquid.

Hereinafter, embodiments of the present invention will be described with reference to the drawings. In each drawing, parts having the same function may be designated by the same reference numerals and description thereof may be omitted. The embodiments described below are merely examples of the present invention, and the configuration and the method may be appropriately changed without changing the gist of the present invention.

FIG. 1 schematically illustrates a liquid ejection device according to a first embodiment of the present invention. The liquid ejection device is an ink jet recording device that ejects a liquid from an ejection orifice (not illustrated) of a liquid ejecting head 1 toward an external recording medium 2 and records on the recording medium 2. The liquid ejecting head 1 is supplied with a liquid from a storage chamber 21 of a tank 20. The tank 20 is supplied with a liquid from a cartridge 10 which is able to be attached to and detached from a housing (not illustrated) of the liquid ejection device and the tank 20. The cartridge 10 has a liquid storage chamber 11, an atmosphere communication port 12, and a liquid supply portion 13. The liquid storage chamber 11 contains ink, which is an example of a liquid ejected toward the recording medium 2. The atmosphere communication port 12 communicates the liquid storage chamber 11 with the atmosphere. The liquid supply portion 13 is configured such that an opening provided in the liquid storage chamber 11 is closed by a plug member.

The tank 20 has a storage chamber 21, an atmosphere communication port 22, a needle 23, a sensor 24, a rotating member 25, and a support member 27. The storage chamber 21 communicates with the atmosphere through the atmosphere communication port 22. The needle 23 is a hollow needle protruding from the storage chamber 21 and pierces the plug member of the liquid supply portion 13 of the cartridge 10 to couple the liquid storage chamber 11 of the cartridge 10 and the storage chamber 21 of the tank 20. Therefore, the liquid in the liquid storage chamber 11 of the cartridge 10 is able to be circulated to the storage chamber 21 of the tank 20 via the liquid supply portion 13 and the needle 23. The storage chamber 21 of the tank 20 stores the liquid supplied from the cartridge 10.

Figure 2:
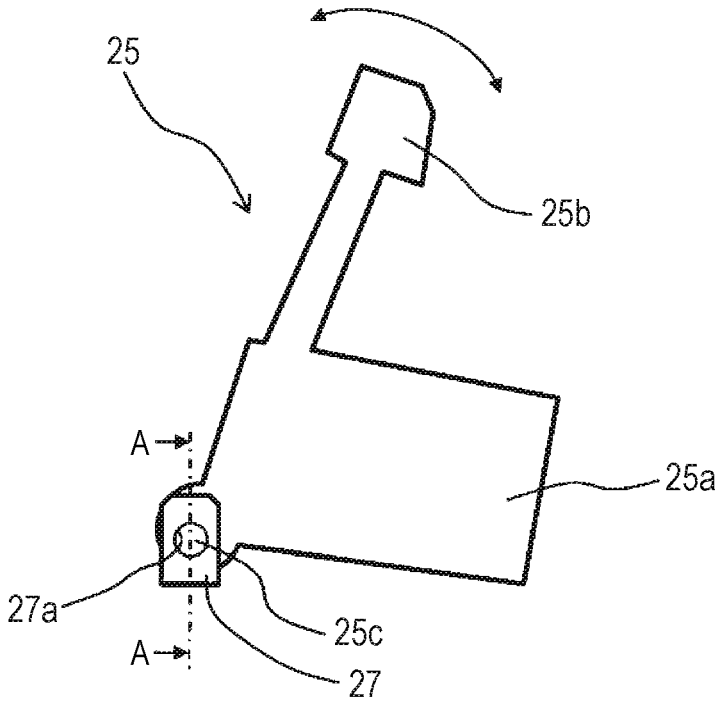
FIG. 2 is an enlarged front view illustrating a rotating member and a support member of a liquid remaining amount detecting mechanism of a liquid ejection device illustrated in FIG. 1.
Figure 3A:
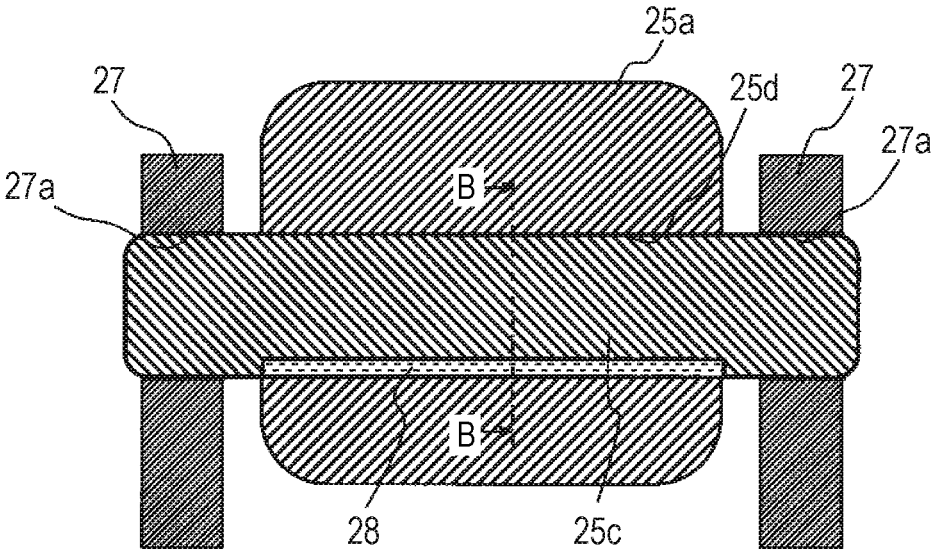
FIG. 3A is a cross-sectional view illustrating a main part of a rotating member and a support member illustrated in FIG. 2.
Figure 3B:
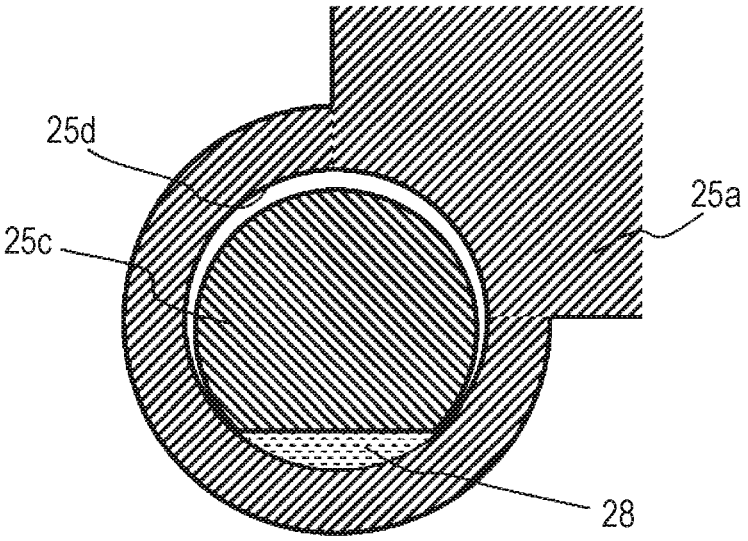
FIG. 3B is a cross-sectional view illustrating a main part of a rotating member and a support member illustrated in FIG. 2.

FIG. 2 is an enlarged front view of the rotating member 25 of the liquid remaining amount detecting mechanism of the liquid ejection device illustrated in FIG. 1. FIG. 3A is a cross-sectional view taken along line A-A of FIG. 2, and FIG. 3B is a cross-sectional view taken along line B-B of FIG. 3A. The rotating member 25 has a float 25*a*, a detection target portion 25*b*, and a shaft 25*c*. A through-hole 25*d* is provided on one side portion of the float 25*a*, and the shaft 25*c* is inserted into the through-hole 25*d*. As a result, a rotating stroke of the float 25*a* is large. The detection target portion 25*b* is coupled to the float 25*a* on a side portion opposite to the one side portion where the through-hole 25*d* is provided. The float 25*a* has a specific gravity smaller than a specific gravity of the liquid stored in the storage chamber 21, and receives buoyancy from the liquid. The float 25*a* may be formed of a material having a specific gravity smaller than a specific gravity of the liquid. Further, the float 25*a* is a swim bladder-like member having a hollow structure and containing air inside, and the float 25*a* as a whole may have a specific gravity smaller than a specific gravity of the liquid, even when the float 25*a* is formed of a material having a specific gravity equal to or larger than a specific gravity of the liquid. A support member 27 is fixedly provided in a lower portion of the storage chamber 21. The support member 27 is provided with a hole 27*a*. The shaft 25*c* is inserted into the through-hole 25*d* of the float 25*a* and the hole 27*a* of the support member 27, and penetrates the through-hole 25*d* and the hole 27*a*. The rotating member 25 is supported by the support member 27 in the storage chamber 21 and is rotatable about the shaft 25*c*. The float 25*a* is located at the lower portion of the rotating member 25, and the detection target portion 25*b* is located at the upper portion of the rotating member 25. However, the rotating member 25 may be supported by a member other than the support member 27. The detection target portion 25*b* is formed of a material that blocks light emitted from a light emitting unit of the sensor 24, which will be described later.

The sensor 24 is an optical sensor having a light emitting unit and a light receiving unit, and outputs different detection signals depending on whether or not light emitted from the light emitting unit is received by the light receiving unit. The sensor 24 is located in the storage chamber 21 at a position of a predetermined height where the sensor 24 is able to face the detection target portion 25*b*, specifically, at a position facing a portion of the locus through which the detection target portion 25*b* passes when the rotating member 25 rotates. Therefore, a rotational state of the rotating member 25 is able to be detected by detecting whether or not the light emitted from the light emitting unit of the sensor 24 is blocked by the detection target portion 25*b* of the rotating member 25. From a rotational state of the rotating member 25 detected in this way, a position of a liquid level L of the liquid stored in the storage chamber 21 is able to be known. For example, the sensor 24 outputs a low level signal (a signal of which a signal level is less than a threshold) to a control unit (not illustrated), when the light output from the light emitting unit cannot be received by the light receiving unit, that is, when a light receiving intensity is less than a predetermined intensity. On the other hand, the sensor 24 outputs a high level signal (a signal of which a signal level is equal to or higher than a threshold level) to a control unit (not illustrated), when the light output from the light emitting unit is received by the light receiving unit, that is, when a light receiving intensity is equal to or higher than a predetermined intensity. Upon receiving the high level signal, the control unit detects that the remaining amount of the liquid stored in the cartridge 10 is small or the liquid is exhausted. Then, the control unit notifies the user that the cartridge 10 needs to be replaced by displaying a display, lighting an LED, and sounding a buzzer.

A liquid pool portion 28 at least a portion of which is located between the shaft 25*c* of the rotating member 25 and the through-hole 25*d*, and that holds a liquid is provided. As an example, in the present embodiment, as illustrated in FIGS. 3A and 3B, a cutout portion is provided on the outer periphery surface of the shaft 25*c*, and a space is formed between the cutout portion and the inner peripheral surface of the through-hole 25*d*. In a state where the shaft 25*c* is immersed in the liquid, the liquid infiltrates into the space and is held as it is. That is, the space formed by the cutout portion is the liquid pool portion 28.

Figure 4A:
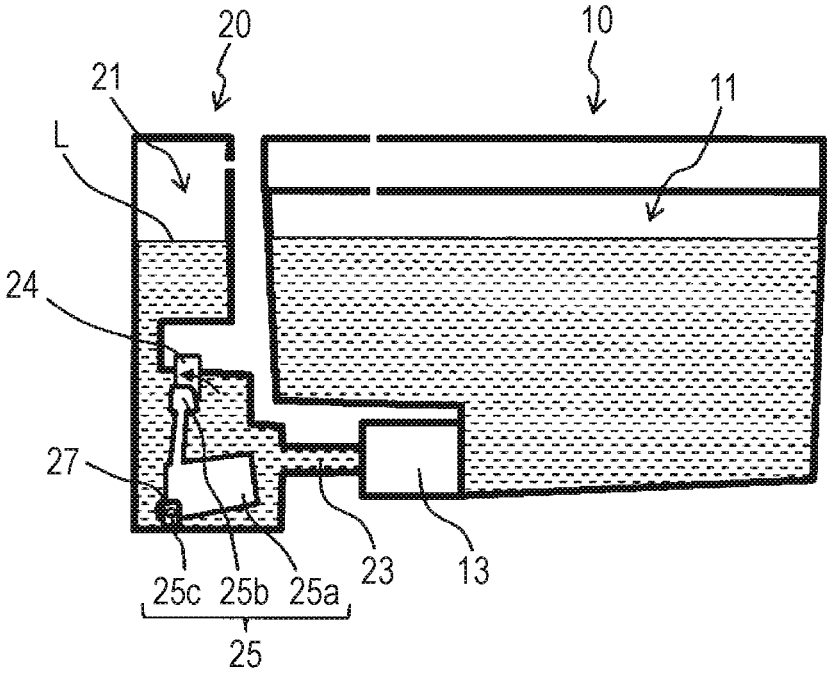
FIG. 4A is a cross-sectional view illustrating a liquid remaining amount detection state of a liquid ejection device illustrated in FIG. 1.

A method for detecting the amount of liquid in the present embodiment will be described. As illustrated in FIG. 4A, the cartridge 10 is mounted on the housing, and the needle 23 of the tank pierces the plug member of the liquid supply portion 13 of the cartridge 10. As a result, the liquid in the liquid storage chamber 11 of the cartridge 10 flows into the storage chamber 21 of the tank 20 via the hollow needle 23. Then, the height of the liquid level L in the liquid storage chamber 11 of the cartridge 10 becomes equal to the height of the liquid level in the storage chamber 21 of the tank 20. When a sufficient amount of liquid exists in the storage chamber 21 of the tank, the height of the liquid level L is high, and the float 25*a* that receives buoyancy from the liquid tries to move upward, and the entire rotating member 25 rotates about the shaft 25*c* (illustrated by an arrow in FIG. 4A). Due to the rotation of the rotating member 25, the detection target portion 25*b* comes to a position between the light emitting unit and the light receiving unit of the sensor 24. When light is emitted from the light emitting unit of the sensor 24, the light is blocked by the detection target portion 25*b*. As a result, the light receiving unit of the sensor 24 does not receive the light, and the sensor 24 outputs a low level signal to the control unit. The control unit receives the low level signal and determines that a sufficient amount of liquid exists in the storage chamber 21 of the tank 20. At this time, the shaft 25*c* of the rotating member 25 is immersed in the liquid, and the liquid pool portion 28 is filled with the liquid.

Figure 4B:
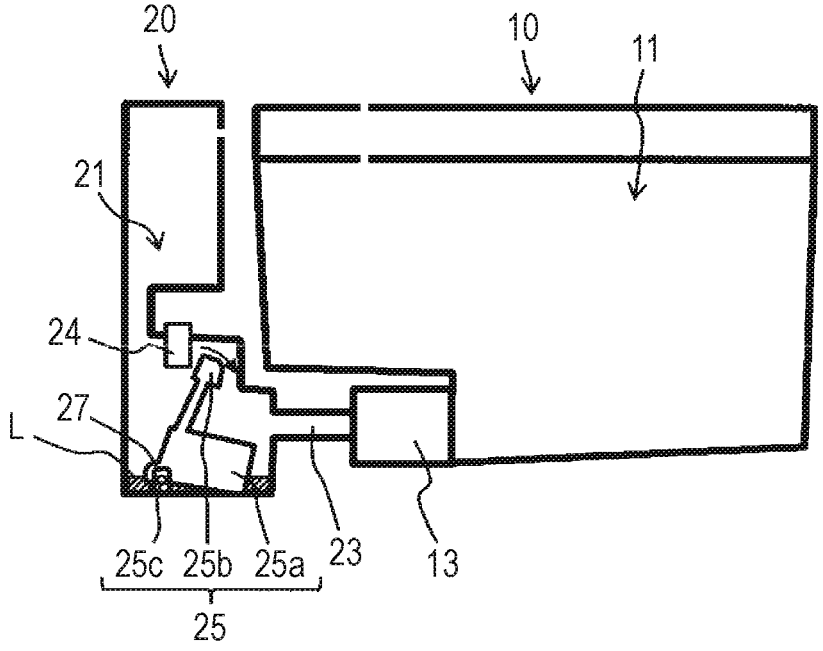
FIG. 4B is a cross-sectional view illustrating a liquid remaining amount detection state of a liquid ejection device illustrated in FIG. 1.

When the liquid is ejected by the liquid ejecting head 1, the amount of liquid inside the storage chamber 21 of the tank 20 and the liquid storage chamber 11 of the cartridge 10 decreases. When the amount of liquid decreases and the liquid level L in the storage chamber 21 of the tank 20 comes below the float 25*a* of the rotating member 25 as illustrated in FIG. 4B, the float 25*a* follows the lowering of the liquid level L and tries to move downward by gravity. As a result, the entire rotating member 25 rotates (illustrated by an arrow in FIG. 4B). Due to the rotation of the rotating member 25, the detection target portion 25*b* retracts from the position between the light emitting unit and the light receiving unit of the sensor 24. When light is emitted from the light emitting unit of the sensor 24, the light is not blocked by the detection target portion 25*b* but is received by the light receiving unit. Therefore, the sensor 24 outputs a high level signal to the control unit. The control unit receives the high level signal and determines that the liquid in the storage chamber 21 of the tank 20 has decreased. Then, the control unit notifies the user that the cartridge 10 needs to be replaced by displaying a display, lighting an LED, and sounding a buzzer.

Even when the amount of liquid in the storage chamber 21 of the tank 20 decreases in this way, as illustrated in FIGS. 3A and 3B, the liquid in the liquid pool portion 28 remains held between the outer peripheral surface of the shaft 25*c* of the rotating member 25 and the inner peripheral surface of the through-hole 25*d*. The function of the liquid pool portion 28 will be described. As described above, even when the liquid in the storage chamber 21 of the tank 20 decreases and the control unit notifies that the cartridge 10 needs to be replaced, the cartridge 10 may be left unreplaced. In such a case, in the configuration in which the liquid pool portion 28 does not exist, a solvent in the remaining small amount of liquid may evaporate, leaving only the solid component, and the liquid may solidify. In particular, since the amount of the liquid existing in a small gap (play) between the outer peripheral surface of the shaft 25*c* and the inner peripheral surface of the through-hole 25*d* is small, the solvent easily evaporates and solidifies when it comes into contact with the atmosphere. When the liquid in contact with the outer peripheral surface of the shaft 25*c* and the inner peripheral surface of the through-hole 25*d* solidifies, the solidified liquid may fix the outer peripheral surface of the shaft 25*c* and the inner peripheral surface of the through-hole 25*d* to each other, and the float 25*a* may not rotate smoothly. Then, even when the cartridge 10 is replaced and new liquid flows from the cartridge 10 into the storage chamber of the tank 20 and the float 25*a* receives buoyancy from the liquid, the rotating member 25 cannot rotate because it is fixed to the solidified liquid. As a result, it becomes difficult to detect the remaining amount of the liquid by using the sensor 24 and the detection target portion 25*b*, and the control unit cannot notify the necessity of replacing the cartridge 10 at an appropriate timing. Further, in a case where no liquid exists in the small gap (play) between the outer peripheral surface of the shaft 25*c* and the inner peripheral surface of the through-hole 25*d*, a friction between the outer peripheral surface of the shaft 25*c* and the inner peripheral surface of the through-hole 25*d* may make smooth rotation difficult. Further, depending on an accuracy of the shapes and dimensions of the shaft 25*c* and the through-hole 25*d*, rattling may occur between the shaft 25*c* and the through-hole 25*d*, and the rotation may not be performed smoothly.

On the other hand, in the present embodiment, the liquid pool portion 28 is provided between the shaft 25*c* and the through-hole 25*d*. Even when the amount of the liquid in the storage chamber 21 of the tank 20 decreases, the liquid is held in the liquid pool portion 28. For example, in the example illustrated in FIGS. 3A and 3B, since the outer peripheral surface of the shaft 25*c* is cut out to form the liquid pool portion 28, a certain amount of liquid exists in the liquid pool portion 28. Since there is a larger amount of liquid existing between the shaft 25*c* and the through-hole 25*d* than in a case where the liquid pool portion 28 does not exist, even when the liquid comes into contact with the atmosphere, there is little possibility that the solvent will evaporate and the liquid will solidify. Further, when a liquid exists between the outer peripheral surface of the shaft 25*c* and the inner peripheral surface of the through-hole 25*d*, the liquid acts as a lubricant, and the shaft 25*c* easily rotates smoothly in the through-hole 25*d*. As described above, according to the present embodiment, even when the remaining amount of liquid in the storage chamber 21 of the tank 20 decreases and the shaft 25*c* of the rotating member 25 is exposed and comes into contact with the atmosphere, the state in which the rotating member 25 is able to rotate smoothly is maintained. Therefore, when the remaining amount of liquid in the storage chamber 21 decreases and the cartridge 10 is replaced, the shaft 25*c* is able to rotate smoothly, and the remaining amount of liquid is able to be detected by using the sensor 24 and the detection target portion 25*b*. As a result, the control unit is able to notify the necessity of replacing the cartridge 10 at an appropriate timing. That is, in the present embodiment, since the liquid pool portion 28 is provided between the shaft 25*c* and the through-hole 25*d*, it is possible to prevent the remaining amount of liquid from becoming undetectable.

The liquid pool portion 28 illustrated in FIGS. 3A and 3B is formed by at least one cutout portion provided on the outer peripheral surface of the shaft 25*c*. Even when the liquid level L in the storage chamber 21 of the tank 20 is lowered, the liquid is held in the liquid pool portion 28 between the through-hole 25*d* and the shaft 25*c*. The position where the cutout portion to be the liquid pool portion 28 is provided may be any position as long as it is the outer peripheral surface of the shaft 25*c* and is open in the storage chamber 21. A plurality of liquid pool portions 28 may be provided on the outer peripheral surface of the shaft 25*c*. In order to delay the timing at which the liquid held in the liquid pool portion 28 comes into contact with the atmosphere and further suppress the evaporation of the solvent, the liquid pool portion 28 may be provided on a lower portion (bottom side of the through-hole 25*d*) of the outer peripheral surface of the shaft 25*c* in the vertical direction.

Figure 5A:
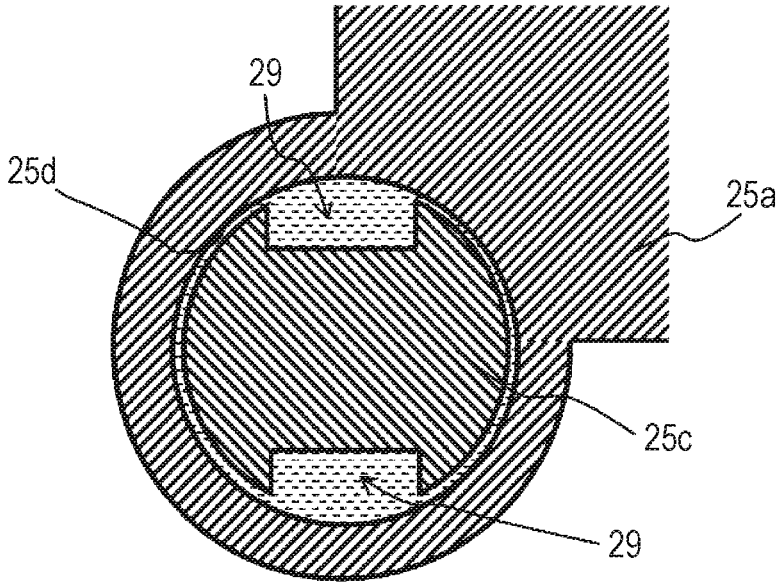
FIG. 5A is a cross-sectional view illustrating a main part of a rotating member according to a second embodiment of the present invention.
Figure 5B:
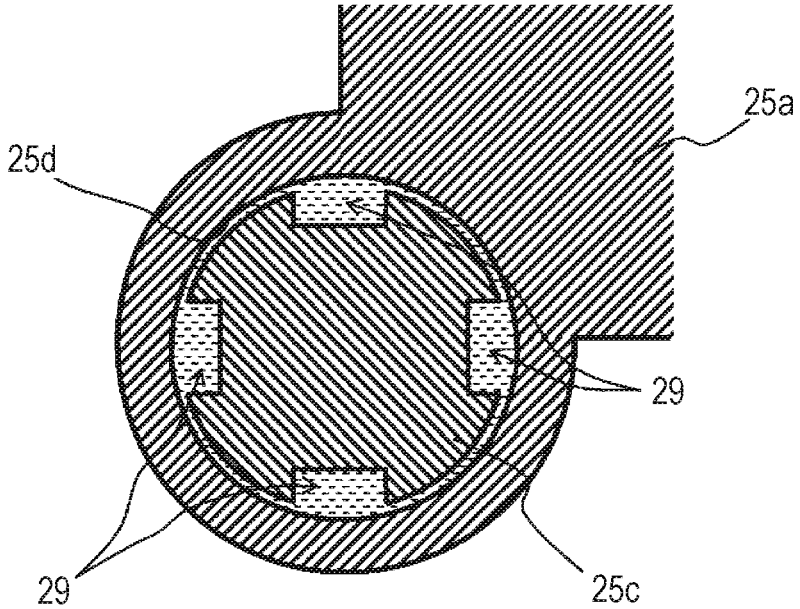
FIG. 5B is a cross-sectional view illustrating a main part of a rotating member according to a second embodiment of the present invention.

The liquid pool portion of the present invention is not limited to the configuration in which a portion of the outer peripheral surface of the shaft 25*c* is cut out as described above. For example, in a second embodiment of the present invention illustrated in FIGS. 5A and 5B, liquid pool portions 29 are formed by recesses provided on the outer peripheral surface of the shaft 25*c*. Since the liquid pool portions 29 of the present embodiment have a concave shape that is recessed from the outer peripheral surface of the shaft 25*c* toward a center portion, the held liquid is unlikely to flow out to the periphery of the liquid pool portion 29. Therefore, the liquid pool portion 29 of the present embodiment is highly reliable in that it can prevent the liquid from solidifying, maintain the smooth rotation of the rotating member 25, and detect the remaining amount of the liquid. The number and position of the liquid pool portions 29 are not limited, and the liquid pool portion 29 may be formed at any position by any number as illustrated in FIGS. 5A and 5B.

Figure 6A:
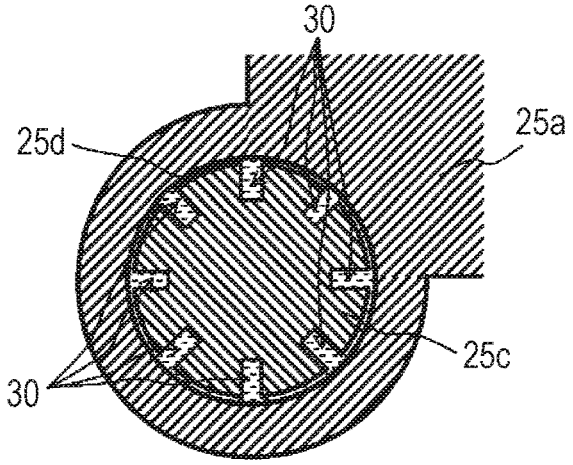
FIG. 6A is a cross-sectional view illustrating a main part of a rotating member according to a third embodiment of the present invention.
Figure 6B:
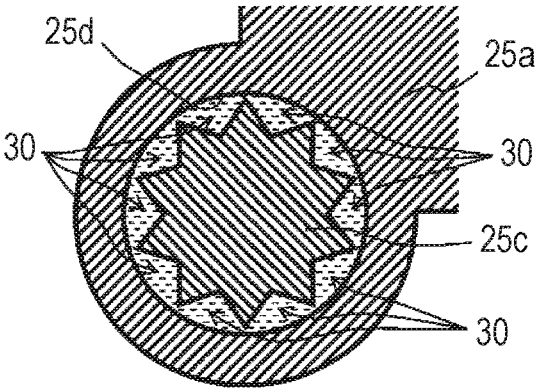
FIG. 6B is a cross-sectional view illustrating a main part of a rotating member according to a third embodiment of the present invention.
Figure 6C:
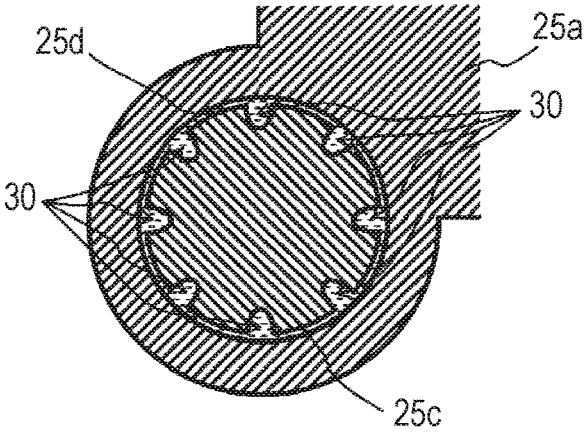
FIG. 6C is a cross-sectional view illustrating a main part of a rotating member according to a third embodiment of the present invention.

In a third embodiment of the present invention illustrated in FIGS. 6A to 6C, liquid pool portions 30 are formed by grooves provided on the outer peripheral surface of the shaft 25*c* and extending along the longitudinal direction of the shaft 25*c*. According to the groove-shaped liquid pool portion 30 of the present embodiment, a contact area between the outer peripheral surface of the shaft 25*c* and the inner peripheral surface of the through-hole 25*d* becomes smaller. Therefore, even when the liquid between the outer peripheral surface of the shaft 25*c* and the inner peripheral surface of the through-hole 25*d* solidifies, the outer peripheral surface of the shaft 25*c* and the inner peripheral surface of the through-hole 25*d* are not fixed to each other, and the rotating member 25 is likely to be maintained in a rotatable state. The cross-sectional shape of the groove-shaped liquid pool portion is not particularly limited, and may be any shape such as a rectangle as illustrated in FIG. 6A, a triangle as illustrated in FIG. 6B, and a substantially semicircle as illustrated in FIG. 6C.

Figure 7A:
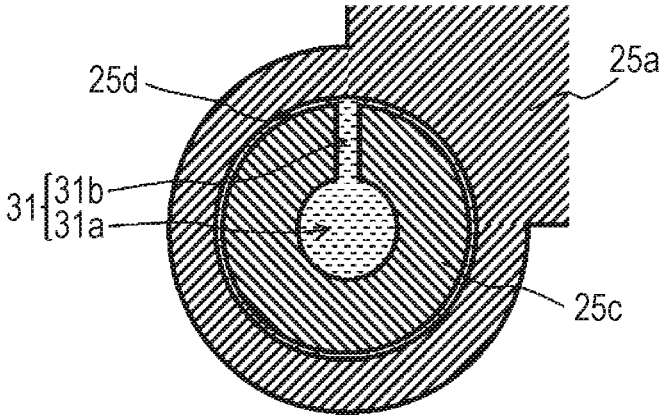
FIG. 7A is a cross-sectional view illustrating a main part of a rotating member according to a fourth embodiment of the present invention.
Figure 7B:
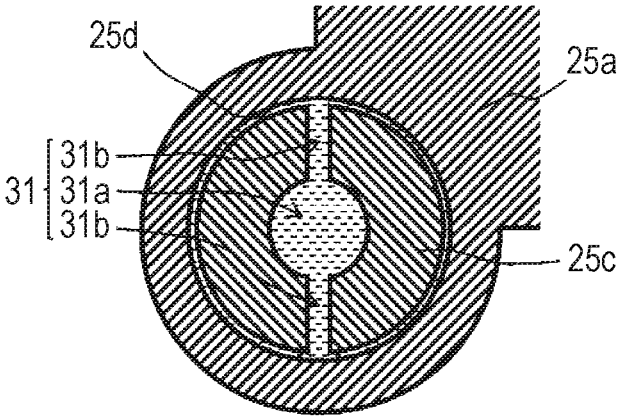
FIG. 7B is a cross-sectional view illustrating a main part of a rotating member according to a fourth embodiment of the present invention.
Figure 7C:
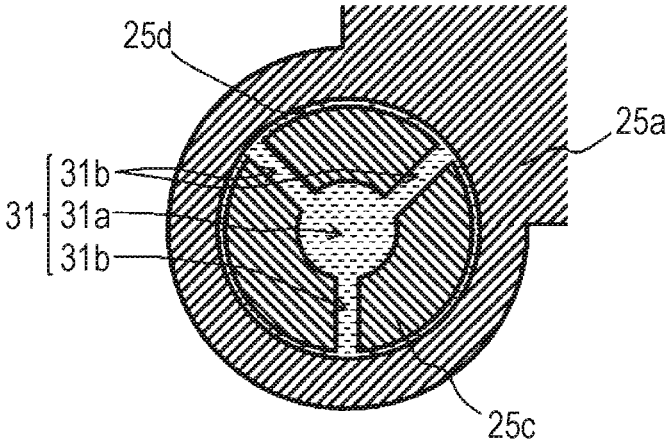
FIG. 7C is a cross-sectional view illustrating a main part of a rotating member according to a fourth embodiment of the present invention.

A liquid pool portion 31 of a fourth embodiment of the present invention illustrated in FIGS. 7A to 7C has a holding space 31*a* located inside the shaft 25*c* and an introduction portion 31*b* extending from the outer peripheral surface of the shaft 25*c* to the holding space 31*a*. According to the present embodiment, it is possible to guide the liquid existing between the outer peripheral surface of the shaft 25*c* and the inner peripheral surface of the through-hole 25*d* to the holding space 31*a* and hold a large amount of liquid in the holding space 31*a*. Since a large amount of liquid held in the holding space 31*a* is not exposed to the atmosphere, evaporation of the solvent is able to be suppressed, and thus thickening and solidification of the liquid are able to be suppressed. Further, since an area of a sliding surface of the outer peripheral surface of the shaft 25*c* in contact with the inner peripheral surface of the through-hole 25*d* is large, the rotating member 25 is likely to rotate smoothly. The holding space 31*a* may be provided near the center of the cross section of the shaft 25*c*. As illustrated in FIGS. 7A to 7C, the introduction portion 31*b* may be formed at any position by any number.

Figure 8A:
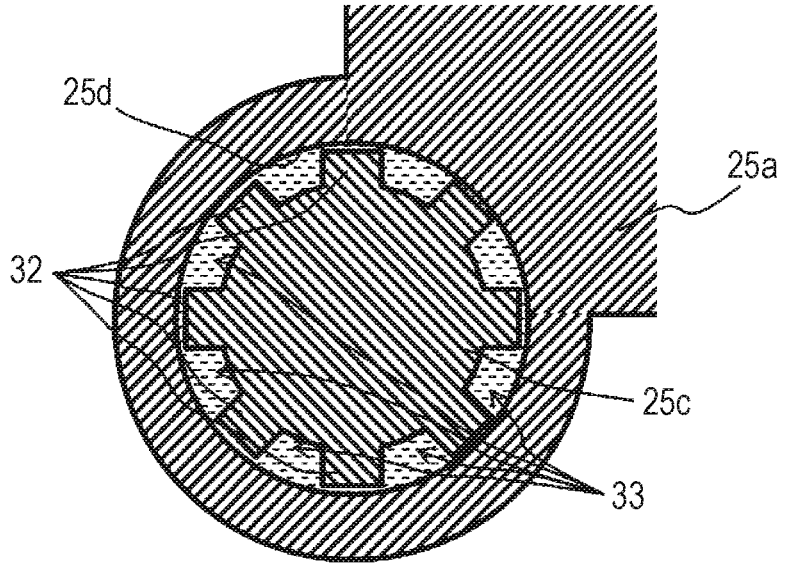
FIG. 8A is a cross-sectional view illustrating a main part of a rotating member according to a fifth embodiment of the present invention.
Figure 8B:
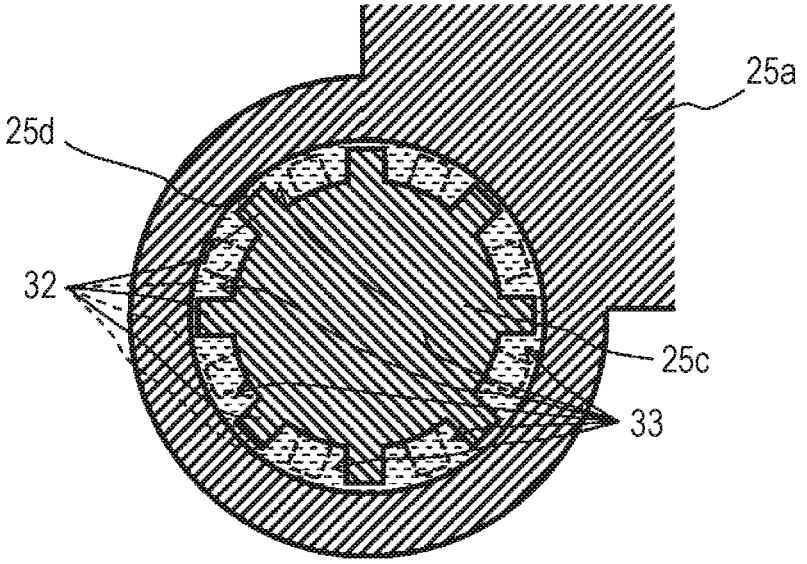
FIG. 8B is a cross-sectional view illustrating a main part of a rotating member according to a fifth embodiment of the present invention.

In a fifth embodiment of the present invention illustrated in FIGS. 8A and 8B, a plurality of protrusions 32 is provided on the outer peripheral surface of the shaft 25*c*, and portions (spaces) located between the plurality of protrusions 32 on the outer peripheral surface serves as the liquid pool portions 33. The through-hole 25*d* has an inner diameter large enough to accommodate the protrusions 32. One or more protrusions 32 are provided on the outer peripheral surface of the shaft 25*c*, and may extend along the longitudinal direction of the shaft 25*c* as illustrated in FIG. 8A. Further, as illustrated in FIG. 8B, a plurality of point-shaped protrusions 32 may be dispersedly disposed. According to the present embodiment, since the liquid pool portions 33 are provided on the outside of the outer peripheral surface of the shaft 25*c*, a large amount of liquid is able to be held. Since the contact area between the outer peripheral surface of the shaft 25*c* and the inner peripheral surface of the through-hole 25*d* is small, it is unlikely that the outer peripheral surface of the shaft 25*c* and the inner peripheral surface of the through-hole 25*d* are fixed to each other, and the rotating member 25 is able to be easily maintained in a rotatable state.

Figure 9A:
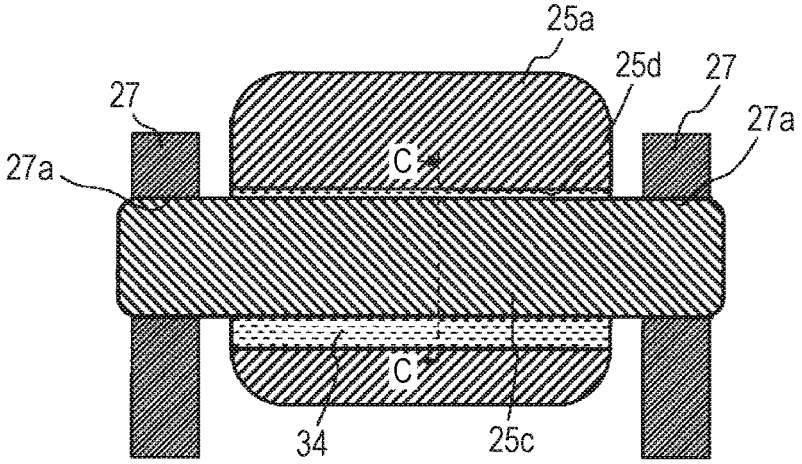
FIG. 9A is a cross-sectional view illustrating a main part of a rotating member and a support member according to a sixth embodiment of the present invention.
Figure 9B:
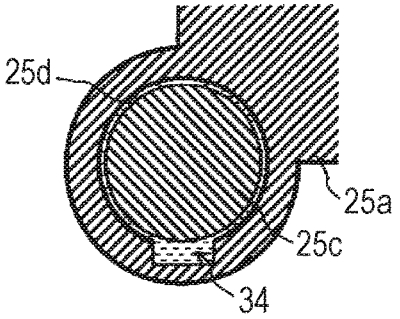
FIG. 9B is a cross-sectional view illustrating a main part of a rotating member and a support member according to a sixth embodiment of the present invention.
Figure 9C:
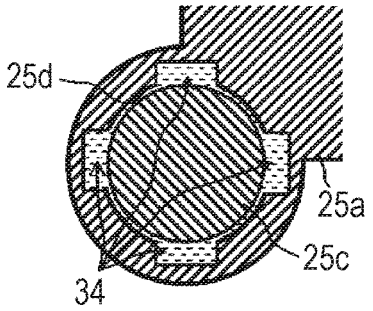
FIG. 9C is a cross-sectional view illustrating a main part of a rotating member and a support member according to a sixth embodiment of the present invention.
Figure 9D:
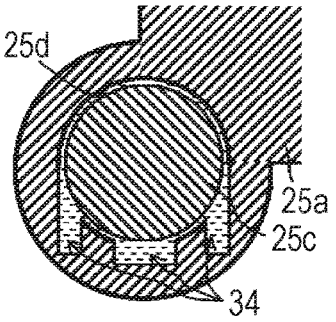
FIG. 9D is a cross-sectional view illustrating a main part of a rotating member and a support member according to a sixth embodiment of the present invention.
Figure 9E:
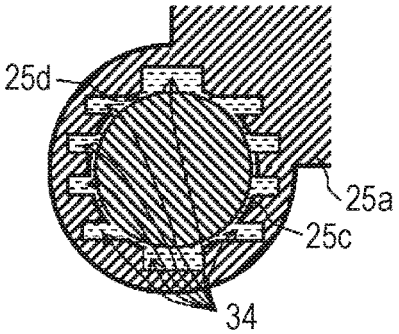
FIG. 9E is a cross-sectional view illustrating a main part of a rotating member and a support member according to a sixth embodiment of the present invention.
Figure 9F:
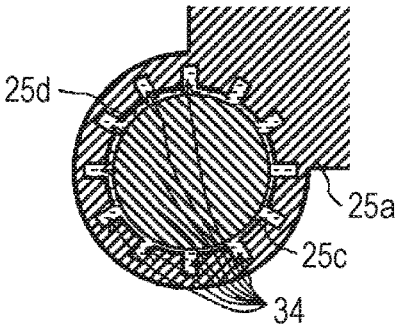
FIG. 9F is a cross-sectional view illustrating a main part of a rotating member and a support member according to a sixth embodiment of the present invention.

In a sixth embodiment of the present invention illustrated in FIGS. 9A to 9F, neither a recess nor a protrusion is formed on the outer peripheral surface of the shaft 25*c*, and on the inner peripheral surface of the through-hole 25*d*, a liquid pool portion 34 formed by a recess or a groove extending along the longitudinal direction of the shaft 25*c* is provided. FIG. 9A is an enlarged front view illustrating the rotating member 25 and the support member 27 of the present embodiment, and FIG. 9B is a cross-sectional view taken along line C-C of FIG. 9A. FIGS. 9C to 9F are cross-sectional views of various modifications of the present embodiment cut at the same position as the line C-C of FIG.

9A. Also in the present embodiment, when a sufficient amount of liquid exists in the storage chamber 21 of the tank 20 and the shaft 25*c* is immersed in the liquid, the liquid pool portion 34 is filled with the liquid. Then, even when the liquid level L in the storage chamber 21 of the tank 20 is lowered, the liquid is held in the liquid pool portion 34. As illustrated in FIGS. 9B to 9F, the shape, position, and number of the liquid pool portions 34 are able to be optionally changed. In order to delay the timing at which the liquid held in the liquid pool portion 34 comes into contact with the atmosphere and further suppress the evaporation of the solvent, the liquid pool portion 34 may be provided on a lower portion (bottom side) of the inner peripheral surface of the through-hole 25*d* in the vertical direction.

Figure 10A:
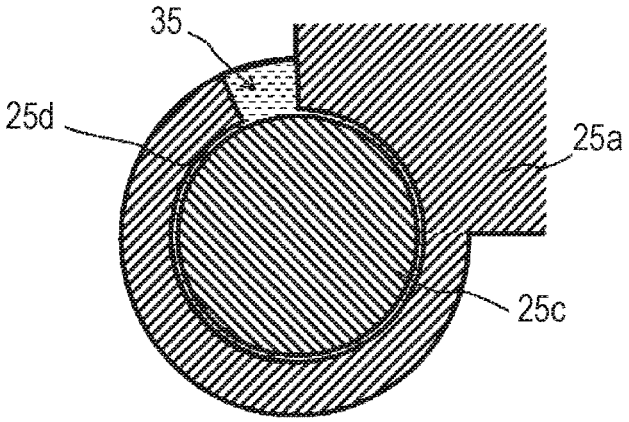
FIG. 10A is a cross-sectional view illustrating a main part of a rotating member according to a seventh embodiment of the present invention.
Figure 10B:
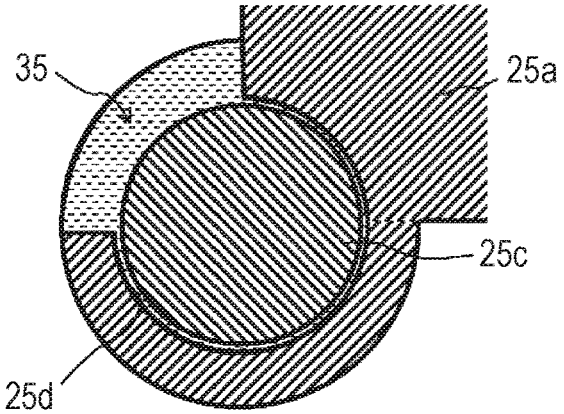
FIG. 10B is a cross-sectional view illustrating a main part of a rotating member according to a seventh embodiment of the present invention.
Figure 10C:
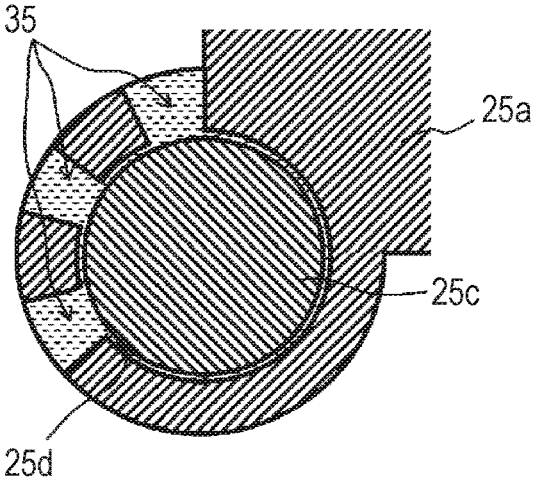
FIG. 10C is a cross-sectional view illustrating a main part of a rotating member according to a seventh embodiment of the present invention.

In a seventh embodiment of the present invention illustrated in FIGS. 10A to 10C, a liquid pool portion 35 is formed by a cutout portion obtained by cutting out a portion of the inner peripheral surface of the through-hole 25*d*. The cutout portion is provided on the inner peripheral surface of the through-hole 25*d* and is open to the outside. According to the present embodiment, a large amount of liquid is able to be easily held. One or more cutout portions configuring the liquid pool portions 35 are provided on the inner peripheral surface of the through-hole 25*d*. The cutout portion may extend along the longitudinal direction of the shaft 25*c*, but in order to increase the reliability of liquid retention, the cutout portion does not extend over the entire length of the shaft 25*c*, and may have a shape partially cut out in the longitudinal direction of the shaft 25*c*. As illustrated in FIGS. 10A and 10B, the size and number of the cutout portion are not limited, and are able to be set optionally. Further, as illustrated in FIG. 10C, a plurality of cutout portions may be arranged side by side in the circumferential direction on the inner peripheral surface of the through-hole 25*d*. In any of the configurations, in order to hold the liquid, at least a portion of the cutout portion configuring the liquid pool portion 35 may be provided on an upper portion (upper surface side) of the through-hole 25*d* in the vertical direction and is opened upward in the vertical direction.

Figure 11A:
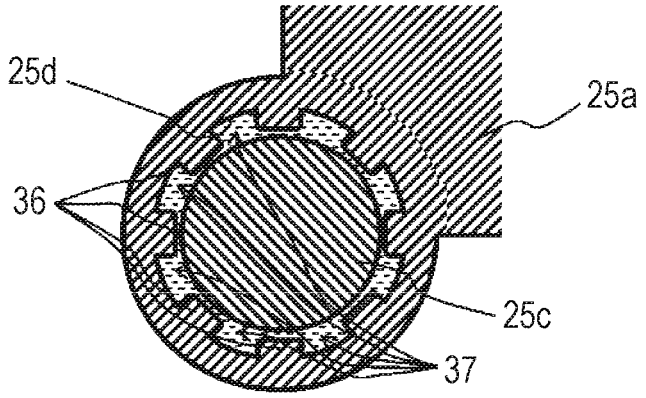
FIG. 11A is a cross-sectional view illustrating a main part of a rotating member according to an eighth embodiment of the present invention.
Figure 11B:
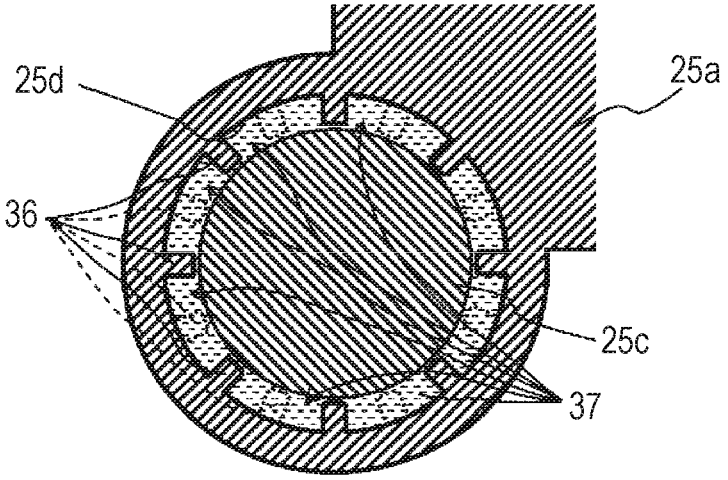
FIG. 11B is a cross-sectional view illustrating a main part of a rotating member according to an eighth embodiment of the present invention.

In an eighth embodiment of the present invention illustrated in FIGS. 11A and 11B, a plurality of protrusions 36 is provided on the inner peripheral surface of the through-hole 25*d*, and portions (spaces) located between the plurality of protrusions 36 on the inner peripheral surface serve as liquid pool portions 37. Although the inner peripheral surface of the through-hole 25*d* is narrowed by the protrusions 36, the through-hole 25*d* and the protrusions 36 are formed in a size such that the shaft 25*c* is able to be inserted into the narrowed region. One or more protrusions 36 are provided on the inner peripheral surface of the through-hole 25*d*, and may extend along the longitudinal direction of the shaft 25*c* as illustrated in FIG. 11A. Further, as illustrated in FIG. 11B, a plurality of point-shaped protrusions 36 may be dispersedly disposed. According to the present embodiment, a large amount of liquid is able to be held in the liquid pool portion 37. Since the contact area between the outer peripheral surface of the shaft 25*c* and the inner peripheral surface of the through-hole 25*d* is small, it is unlikely that the outer peripheral surface of the shaft 25*c* and the inner peripheral surface of the through-hole 25*d* are fixed to each other, and the rotating member 25 is able to be easily maintained in a rotatable state.

In a ninth embodiment of the present invention illustrated in FIGS. 12A to 12D, a liquid pool portion is provided on the outer peripheral surface of the shaft 25*c*, and a liquid pool portion is provided also on the inner peripheral surface of the through-hole 25*d*. For convenience, a liquid pool portion on the outer peripheral surface of the shaft 25*c* may be referred to as a first liquid pool portion, and a liquid pool portion on the inner peripheral surface of the through-hole 25*d* may be referred to as a second liquid pool portion.

Figure 12A:
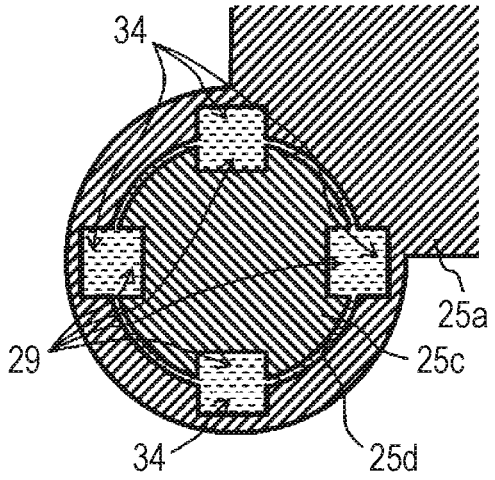
FIG. 12A is a cross-sectional view illustrating a main part of a rotating member according to a ninth embodiment of the present invention.

In the configuration illustrated in FIG. 12A, the liquid pool portions 29 are configured by the recesses provided on the outer peripheral surface of the shaft 25*c*, as in the second embodiment illustrated in FIG. 5B. Further, as in the sixth embodiment illustrated in FIG. 9C, the liquid pool portions 34 are formed by the recesses provided on the inner peripheral surface of the through-hole 25*d*. According to the configuration, the same effect as that of the second embodiment described above and the same effect as that of the sixth embodiment are able to be obtained.

Figure 12B:
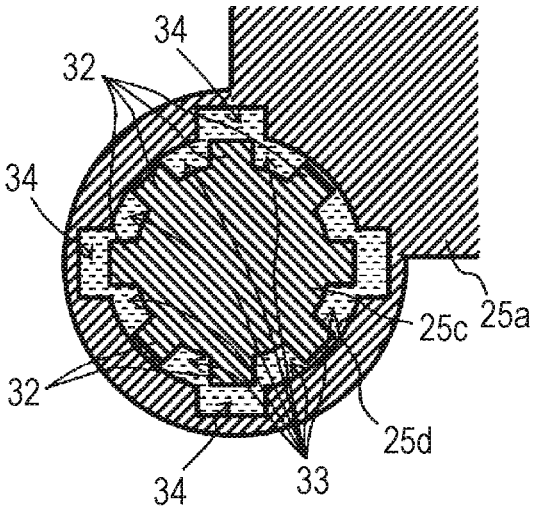
FIG. 12B is a cross-sectional view illustrating a main part of a rotating member according to a ninth embodiment of the present invention.

In the configuration illustrated in FIG. 12B, protrusions 32 and liquid pool portions 33 are provided on the outer peripheral surface of the shaft 25*c*, as in the fifth embodiment illustrated in FIG. 8A. Further, as in the sixth embodiment illustrated in FIG. 9C, the liquid pool portions 34 are formed by the recesses provided on the inner peripheral surface of the through-hole 25*d*. According to the configuration, the same effect as that of the fifth embodiment described above and the same effect as that of the sixth embodiment are able to be obtained.

Figure 12C:
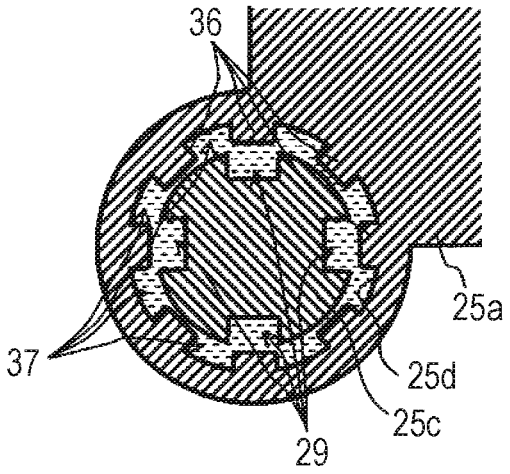
FIG. 12C is a cross-sectional view illustrating a main part of a rotating member according to a ninth embodiment of the present invention.

In the configuration illustrated in FIG. 12C, the liquid pool portions 29 are configured by the recesses provided on the outer peripheral surface of the shaft 25*c*, as in the second embodiment illustrated in FIG. 5B. Further, as in the eighth embodiment illustrated in FIG. 11A, protrusions 36 and liquid pool portions 37 are provided on the inner peripheral surface of the through-hole 25*d*. According to the configuration, the same effect as that of the second embodiment described above and the same effect as that of the eighth embodiment are able to be obtained.

Figure 12D:
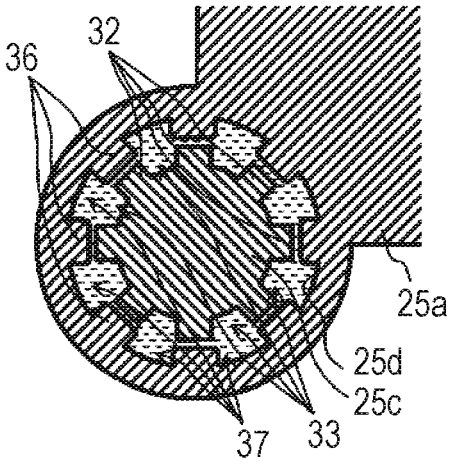
FIG. 12D is a cross-sectional view illustrating a main part of a rotating member according to a ninth embodiment of the present invention.

In the configuration illustrated in FIG. 12D, protrusions 32 and liquid pool portions 33 are provided on the outer peripheral surface of the shaft 25*c*, as in the fifth embodiment illustrated in FIG. 8A. Further, as in the eighth embodiment illustrated in FIG. 11A, protrusions 36 and liquid pool portions 37 are provided on the inner peripheral surface of the through-hole 25*d*. According to the configuration, the same effect as that of the fifth embodiment described above and the same effect as that of the eighth embodiment are able to be obtained.

As described above, in the present embodiment, the same effect as that of any of the first to fifth embodiments is able to be obtained by providing the liquid pool portion on the outer peripheral surface of the shaft 25*c*. Further, by providing the liquid pool portion on the inner peripheral surface of the through-hole 25*d*, the same effect as that of any of the sixth to eighth embodiments is able to be obtained. Since the liquid pool portions are respectively provided on the outer peripheral surface of the shaft 25*c* and the inner peripheral surface of the through-hole 25*d*, the total volume of the liquid pool portions is large and the amount of liquid that is able to be held is large. As a result, it takes a long time for the solvent of the liquid to evaporate between the outer peripheral surface of the shaft 25*c* and the inner peripheral surface of the through-hole 25*d*, and thus the possibility that the liquid solidifies is small. In the configurations illustrated in FIGS. 12A and 12D, the liquid pool portion (first liquid pool portion) provided on the outer peripheral surface of the shaft 25*c* and the liquid pool portion (second liquid pool portion) provided on the inner peripheral surface of the through-hole 25*d* face each other. According to the configuration, the liquid easily infiltrates into both liquid pool portions, and the liquid retention is highly reliable. On the other hand, in the configurations illustrated in FIGS. 12B and 12C, the liquid pool portion (first liquid pool portion) provided on the outer peripheral surface of the shaft 25*c* and the liquid pool portion (second liquid pool portion) provided on the inner peripheral surface of the through-hole 25*d* are disposed at positions so that they do not face each other. According to the configuration, the portion where the outer peripheral surface of the shaft 25*c* and the inner peripheral surface of the through-hole 25*d* face each other with almost no gap is small, and thus the portion easily fixed to each other by the solidification of the liquid is very small. Therefore, it is unlikely that the rotating member 25 will be difficult to rotate smoothly due to the solidification of the liquid located between the outer peripheral surface of the shaft 25*c* and the inner peripheral surface of the through-hole 25*d*. Note that, the configuration is not limited to the configurations illustrated in FIGS. 12A to 12D, and the liquid pool portion provided on the outer peripheral surface of the shaft 25*c* and the liquid pool portion provided on the inner peripheral surface of the through-hole 25*d* may have any form as long as the liquid is able to be held.

As is clear from each of the embodiments described above, in the present invention, the detection target portion 25*b* and the sensor 24 detect that the remaining amount of liquid is large in a state where a sufficient amount of liquid exists in the storage chamber 21 of the tank 20. At this time, the liquid infiltrates into the liquid pool portion provided on one or both of the outer peripheral surface of the shaft 25*c* and the inner peripheral surface of the through-hole 25*d*. When the amount of liquid in the storage chamber 21 decreases from the state, the rotating member 25 rotates as the liquid level L is lowered. As a result, it is detected by the detection target portion 25*b* and the sensor 24 that the remaining amount of the liquid has decreased. Even when the liquid level L is lowered below the liquid pool portion of the rotating member 25, the liquid in the liquid pool portion is held. Even when the liquid in the storage chamber 21 is left in a decreased state in this way, since the liquid is held in the liquid pool portion, the amount of liquid existing between the outer peripheral surface of the shaft 25*c* and the inner peripheral surface of the through-hole 25*d* is large. Since the amount of liquid is large, the solvent does not easily evaporate, and thus the solidification of the liquid is suppressed. Therefore, the state in which the rotating member 25 is able to smoothly rotate about the shaft is maintained. Further, when a liquid is held in the liquid pool portion and a large amount of liquid exists between the outer peripheral surface of the shaft 25*c* and the inner peripheral surface of the through-hole 25*d*, this liquid functions as a lubricant, and the rotating member 25 is able to easily rotate smoothly without causing rattling. Therefore, when a liquid is replenished from the cartridge 10 into the storage chamber 21 of the tank 20, the float 25*a* rises again and the remaining amount of the liquid is able to be detected. That is, it is possible to prevent the remaining amount of liquid from becoming undetectable.

Note that, in the present invention, the liquid that is retained in the storage chamber and of which the remaining amount is detected is not limited to ink. For example, the remaining amount of a pretreatment liquid ejected to the recording medium prior to the ink during recording may be detected based on the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-062944, filed Mar. 31, 2020, which is hereby incorporated by reference herein in its entirety.

What is claimed is:

1. A liquid remaining amount detecting mechanism comprising:

a rotating member that is disposed in a storage chamber of a tank that stores a liquid; and a sensor, wherein the rotating member is rotatable about a shaft and includes a float that receives buoyancy from the liquid, a detection target portion that is detectable by the sensor, and a through-hole into which the shaft is inserted, the sensor is disposed at a position facing a portion of a locus of the detection target portion when the rotating member is rotated, and the liquid remaining amount detecting mechanism further comprises a liquid pool portion, at least a portion of which is located between an outer peripheral surface of the shaft and an inner peripheral surface of the through-hole to hold the liquid.

2. The liquid remaining amount detecting mechanism according to claim 1, wherein the float has a specific gravity smaller than a specific gravity of the liquid, and the through-hole is provided on one side portion of the float.

3. The liquid remaining amount detecting mechanism according to claim 2, wherein the detection target portion is coupled to a side portion of the float opposite to the one side portion.

4. The liquid remaining amount detecting mechanism according to claim 1, wherein at least a portion of the liquid pool portion is formed by a recess provided on the outer peripheral surface of the shaft.

5. The liquid remaining amount detecting mechanism according to claim 1, wherein at least a portion of the liquid pool portion is formed by a groove provided on the outer peripheral surface of the shaft and extending along a longitudinal direction of the shaft.

6. The liquid remaining amount detecting mechanism according to claim 1, wherein at least a portion of the liquid pool portion has a holding space located inside the shaft and an introduction portion extending from the outer peripheral surface of the shaft to the holding space.

7. The liquid remaining amount detecting mechanism according to claim 1, wherein at least a portion of the liquid pool portion is formed by a space between a plurality of protrusions provided on the outer peripheral surface of the shaft.

8. The liquid remaining amount detecting mechanism according to claim 7, wherein the protrusions extend along a longitudinal direction of the shaft.

9. The liquid remaining amount detecting mechanism according to claim 7, wherein a plurality of the point-shaped protrusions is disposed to be dispersed on the outer peripheral surface of the shaft.

10. The liquid remaining amount detecting mechanism according to claim 1, wherein at least a portion of the liquid pool portion is provided on a lower portion of the outer peripheral surface of the shaft in a vertical direction.

11. The liquid remaining amount detecting mechanism according to claim 1, wherein at least a portion of the liquid pool portion is formed by a recess provided on the inner peripheral surface of the through-hole.

12. The liquid remaining amount detecting mechanism according to claim 1, wherein at least a portion of the liquid pool portion is formed by a groove provided on the inner peripheral surface of the through-hole and extending along a longitudinal direction of the shaft.

13. The liquid remaining amount detecting mechanism according to claim 1, wherein at least a portion of the liquid pool portion is formed by a space between a plurality of protrusions provided on the inner peripheral surface of the through-hole.

14. The liquid remaining amount detecting mechanism according to claim 13, wherein the protrusions extend along a longitudinal direction of the shaft.

15. The liquid remaining amount detecting mechanism according to claim 13, wherein a plurality of the point-shaped protrusions is disposed to be dispersed on the inner peripheral surface of the through-hole.

16. The liquid remaining amount detecting mechanism according to claim 1, wherein at least a portion of the liquid pool portion is provided on a lower portion of the inner peripheral surface of the through-hole in a vertical direction.

17. The liquid remaining amount detecting mechanism according to claim 1, wherein at least a portion of the liquid pool portion is formed by a cutout portion provided on the inner peripheral surface of the through-hole, and the cutout portion is open to an outside.

18. The liquid remaining amount detecting mechanism according to claim 17, wherein at least a portion of the cutout portion is provided on an upper portion of the inner peripheral surface of the through-hole in a vertical direction and is open upward in the vertical direction.

19. The liquid remaining amount detecting mechanism according to claim 1, wherein the liquid pool portion has a first liquid pool portion provided on the outer peripheral surface of the shaft and a second liquid pool portion provided on the inner peripheral surface of the through-hole.

20. The liquid remaining amount detecting mechanism according to claim 19, wherein the first liquid pool portion and the second liquid pool portion face each other.

* * * * *